US005415487A

United States Patent [19]

Rukan et al.

[11] Patent Number: 5,415,487

[45] Date of Patent: May 16, 1995

[54] VENTED PLUG FOR INK CARTRIDGES

[75] Inventors: Ronald S. Rukan; Barry W. Chadwick, both of Simpsonville, S.C.

[73] Assignee: BIC Corporation, Milford, Conn.

[21] Appl. No.: 73,726

[22] Filed: Jun. 8, 1993

[51] Int. Cl.[6] ..... B43K 24/08; B43K 7/02

[52] U.S. Cl. ..... 401/117; 401/109; 401/54; 401/217

[58] Field of Search ..... 401/53, 54, 101, 103, 401/109, 110, 111, 117, 132, 219, 217

[56] References Cited

U.S. PATENT DOCUMENTS

| | | | |
|---|---|---|---|
| 2,128,456 | 8/1938 | Dusenbury | 401/54 X |
| 2,397,229 | 3/1946 | Biro . | |
| 2,505,211 | 4/1950 | Schiesel . | |
| 2,730,993 | 1/1956 | Boyle . | |
| 2,804,049 | 8/1957 | Sams . | |
| 2,871,824 | 2/1959 | Sams . | |
| 2,877,744 | 3/1959 | Ray . | |
| 2,946,311 | 7/1960 | Craig | 401/109 |
| 2,951,465 | 9/1960 | Weisser et al. . | |
| 3,113,558 | 12/1963 | Marraffino . | |
| 3,282,254 | 11/1966 | Malm et al. . | |
| 3,415,603 | 12/1968 | Blanchard | 401/110 X |
| 3,698,825 | 10/1972 | Sears et al. . | |
| 3,824,023 | 7/1974 | Danjczek et al. . | |
| 4,382,707 | 5/1983 | Anderka . | |
| 4,418,723 | 12/1983 | Koni et al. . | |
| 4,506,423 | 3/1985 | Nakamura et al. . | |
| 4,565,463 | 1/1986 | Otaguro et al. . | |
| 4,669,906 | 6/1987 | Narushima et al. . | |
| 4,735,546 | 6/1988 | Witz et al. . | |
| 4,930,921 | 6/1990 | Anderka . | |
| 4,938,620 | 7/1990 | Weiss et al. . | |
| 4,940,350 | 7/1990 | Kim . | |

FOREIGN PATENT DOCUMENTS

| | | | |
|---|---|---|---|
| 1252736 | 12/1960 | France | 401/54 |
| 2309347 | 11/1976 | France . | |
| 1228162 | 11/1966 | Germany | 401/54 |
| 2260946 | 5/1993 | United Kingdom . | |

*Primary Examiner*—Danton D. DeMille

*Attorney, Agent, or Firm*—Peter G. Dilworth; Rocco S. Barrese; Joseph J. Catanzaro

[57] ABSTRACT

The subject invention is directed to a cartridge for a writing instrument. In particular, the writing instrument includes a surface against which the cartridge abuts. The cartridge includes a tubular body for containing ink which has a front end including an applicator for applying the ink, and a plug member disposed at least partially in a rear end of the tubular body of the cartridge. The plug member includes a path for permitting airflow into the tubular body, and a flange for cushioning the cartridge against the abutment surface of the writing instrument so as to inhibit separation of the ink from the ink applicator and absorb pressure exerted upon the ink applicator during writing.

14 Claims, 2 Drawing Sheets

FIG. 2
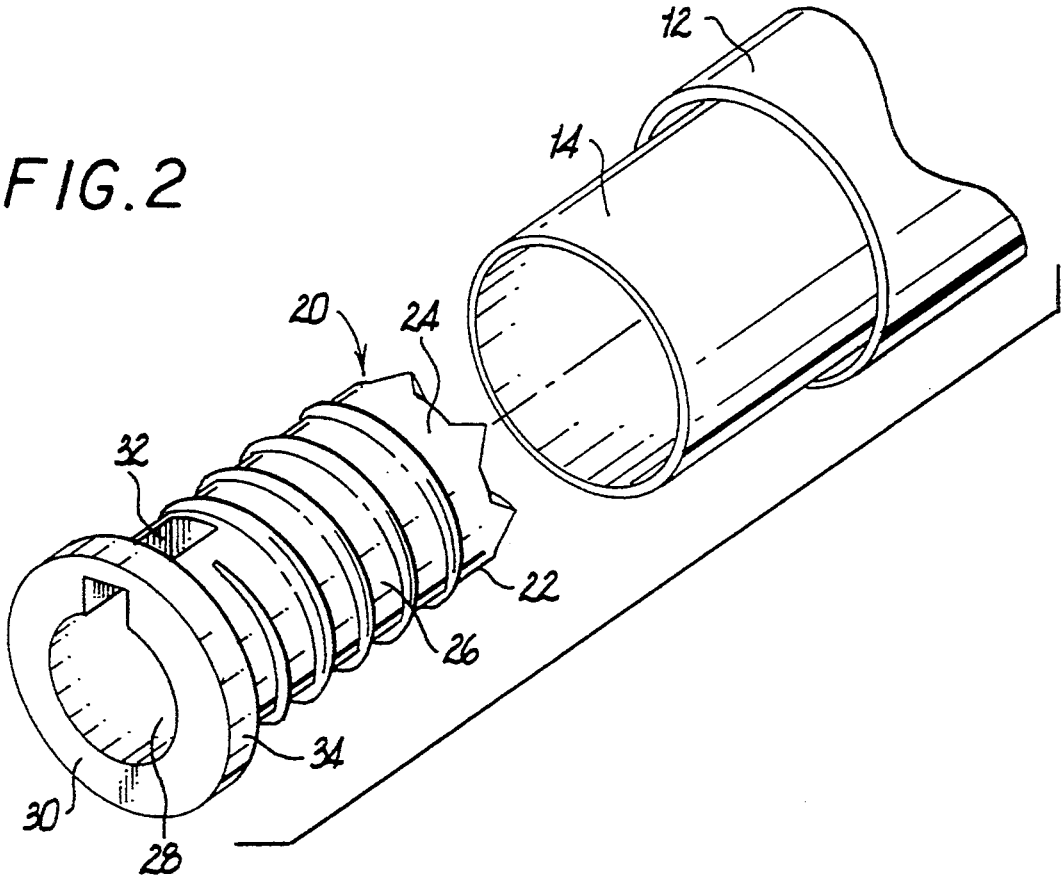
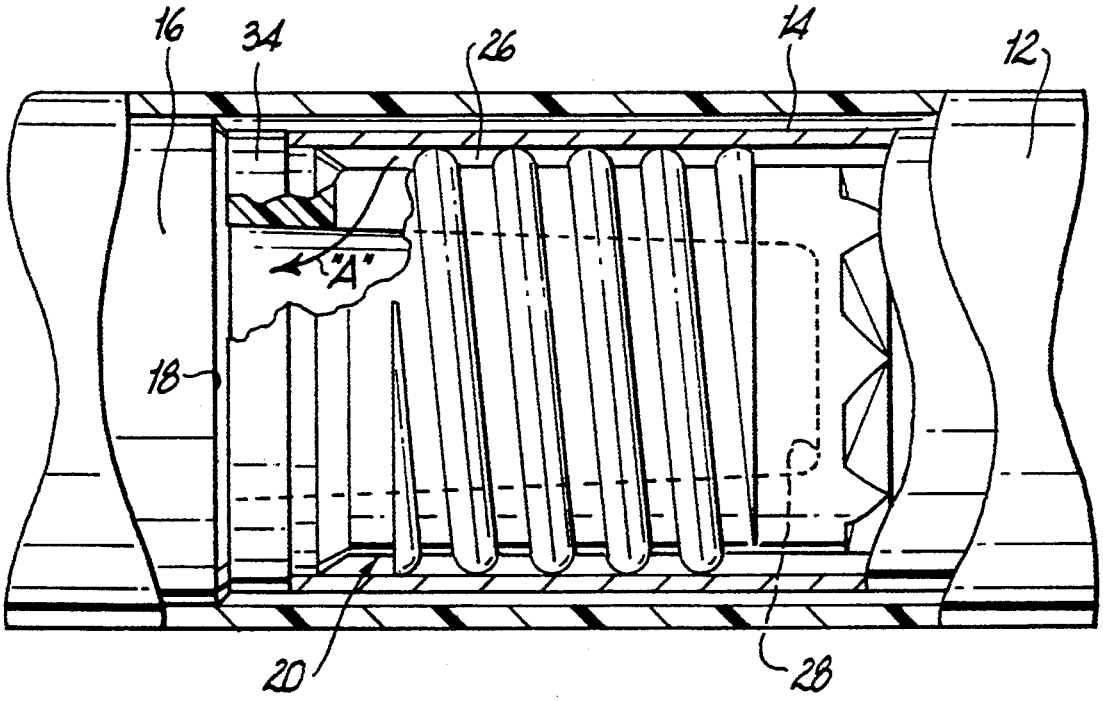
FIG. 3

VENTED PLUG FOR INK CARTRIDGES

BACKGROUND OF THE INVENTION

1. Field of the Invention

The present invention relates to writing instruments, and more particularly to a replaceable ink cartridge having a vent plug disposed in the rear end thereof.

2. Description of the Related Art

Writing instruments utilizing replaceable ink cartridges, and in particular those having ball point tips, are well known in the art to which the subject invention appertains. In the past, it has been observed that ink contained within a cartridge may seep out of the ball seat and leak from the cartridge tip to impede or prevent use of the writing instrument. Those skilled in the art have determined that this problem may result from the accumulation of excessive humidity within the cartridge body. Several mechanisms have been devised to limit the accumulation of humidity within the ink cartridge of a ball point writing instrument including those described, for example, in U.S. Pat. Nos. 2,877,744 to Ray, 3,282,254 to Malta et al., 3,698,825 to Sears et al., and 4,565,463 to Otaguro et al. Each of these patents describe vent plugs adapted to limit air flow to and from the interior of an ink cartridge. In the '744 patent to Ray, for example, an end plug is provided for a ball point pen which is formed with an elongated passage to permit the atmosphere to find access to the inside of the pen. In the '254 patent to Maim et al., a plug is described which is formed with a circular pathway for communicating the interior of the cartridge with ambient atmosphere.

Writing instruments having a retractor mechanism for moving an ink cartridge between a retracted position wherein the applicator tip is disposed within the pen body and a protracted position wherein the applicator tip is disposed outside the pen body are also well known in the art to which the subject invention appertains. Examples of retractable writing instruments are described in U.S. Pat. No. 3,326,189 to Baer and U.S. Pat. No. 4,221,490 to Maim. These instruments provide a plunger component disposed at the rear end of the pen for actuating the retractor mechanism to move the cartridge. In this type of writing instrument, it has been observed that a problem in the performance of the instrument may occur in that ink may separate from the ball point tip of the cartridge when the plunger is impacted by an undesirably large force, i.e. if dropped to the floor from a desktop. Generally, the end of the cartridge abuts the plunger component, which is rigidly secured in the body of the instrument. The impact caused by dropping the instrument causes the ink to move within the cartridge, since the cartridge itself is immovable with respect to the plunger and body of the instrument. Once the ball point tip and the ink in the cartridge have separated, the cartridge is rendered inoperative and must be discarded.

Yet another problem has been recognized in connection with ball point pens which involves dislocation of the ball point tip. This problem can result from the exertion of an undesirably large force on the applicator tip while writing, which will cause the ball point tip to be pushed from its seat and become lodged within the ink cartridge. In addition, dropping the pen on its tip may damage the tip, wherein the ball becomes unseated and disconnects from the pen. Dislocation of the ball from its seat, of course, will render the cartridge inoperative.

The present invention is directed to a cartridge, and in particular a vented plug disposed in the rear end of an ink cartridge, which overcomes the problems that have been observed in the art of ball point writing instruments.

SUMMARY OF THE INVENTION

The subject invention is directed to replaceable ink cartridges for writing instruments such as ball point pens. Typically, these writing instruments include an abutment surface against which the rear end of the ink cartridge abuts, whether the instrument is retractable through the use of a plunger mechanism or simply of a two piece barrel construction wherein the writing tip is, at all times, exposed for use. The cartridge preferably comprises an elongated tubular body for containing ink having a front end which includes means for applying the ink, and a plug member disposed at least partially in a rear end of the tubular body thereof.

The plug member includes means for permitting airflow into the tubular body to allow the ink to feed the tip while, at the same time, preventing leakage at the rear end of the cartridge. The plug member further includes means for cushioning the cartridge against the abutment surface of the writing instrument so as to inhibit separation of the ink from the ink applying means if the pen is accidentally dropped on its rear end, and to inhibit damage to the applicator tip and to prevent dislocation of the ball point of the tip in the event too much force is exerted on the tip while writing, or if the instrument is dropped on its tip.

Preferably, the plug member is of substantially cylindrical configuration and defines an axial recess which extends partially through the body portion from a rear end thereof. The plug member is also provided with a continuous helical rib which defines a channel about the outer circumferential wall thereof to form at least a portion of a circuitous pathway. A transverse pathway is provided to connect the helical channel with the axial recess so as to permit airflow from the ambient atmosphere into the cartridge. Alternately, a passageway extending axially and radially to connect with the helical channel may replace the axial recess and transverse pathway.

The means for cushioning the cartridge of the subject invention against the abutment surface of the writing instrument preferably comprises an annular flange formed at a rear end of the body portion of the plug. The plug is preferably formed from a resilient material, such as a soft, pliable, rubber material, as is the annular flange which is integral with the plug body. However, it is of course contemplated that the flange may be attached to the body of the plug in such a manner that the flange is constructed of a pliable rubber material while the body may be constructed of a less pliable plastic. Preferably, the rubber material is an ethylene propylene thermoplastic rubber such as SANTOPRENE, which is manufactured by Advanced Elastomer Systems, or a similar material such as neoprene or other soft, pliable materials. In a preferred embodiment of the invention, the surface against which the cartridge abuts is movable with respect to the barrel of the writing instrument, as in retractable pens to retract and protract the writing tip. However, the cartridge is fixed with respect to the abutment surface whether the tip is in or out, since the plunger which terminates in the abutment surface is either locked with the tip protracted or with the tip retracted. In addition, it is envisioned that the surface against which the cartridge abuts may be fixed with respect to the barrel of the writing instrument, as in a conventional pen wherein the cartridge remains stationary and the tip is always outside the pen body. The flange provides a shock absorbing function to cushion the rear end of the cartridge against the abutment surface.

Further features of the subject invention will become more readily apparent to those having ordinary skill in the art from the following detailed description of the invention taken in conjunction with the drawings.

BRIEF DESCRIPTION OF THE DRAWINGS

In order that those skilled in the art to which the subject invention appertains may understand how to make and use the same, a detailed description of the construction thereof in accordance with a preferred embodiment of the invention will follow, referring by numerals to the accompanying drawings wherein:

FIG. 2 is a perspective view of a portion of the ink cartridge and the associated vent plug in accordance with the subject invention;

FIG. 3 is an enlarged side elevational view in cross-section of the writing instrument of FIG. 1 illustrating the vent plug of FIG. 2.

DETAILED DESCRIPTION OF THE PREFERRED EMBODIMENT

Figure 1:
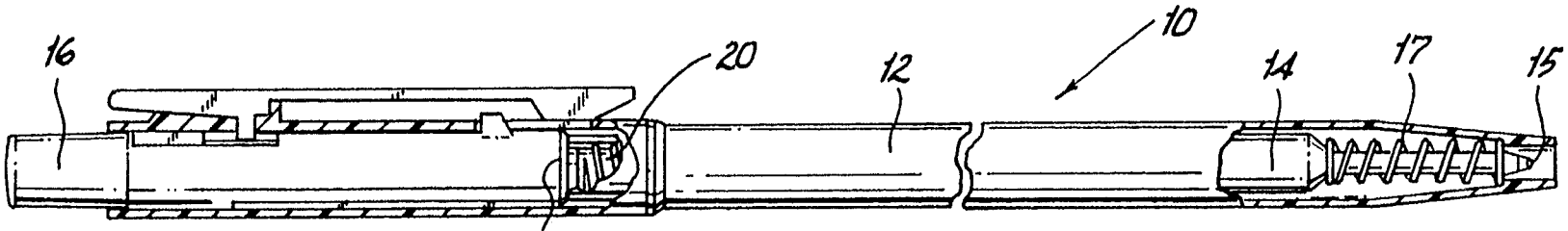
FIG. 1 is a side elevational view in partial cross-section of a retractable writing instrument equipped with an ink cartridge in accordance with a preferred embodiment of the subject invention.

Referring now to the drawings, in which like reference numerals identify similar structural elements, and in particular to FIG. 1, a retractable writing instrument which includes an ink cartridge in accordance with a preferred embodiment of the subject invention is illustrated and is designated generally by reference numeral 10. Writing instrument 10 comprises an elongated barrel portion 12 defining a cavity within which the ink cartridge 14 is housed. Ink cartridge 14 is provided with a ball point tip 15 for applying the ink contained therein. A plunger 16 is provided in the rear end of barrel portion 12 and is associated with a biasing mechanism, such as a coiled spring member 17, for moving the ink cartridge 14 between a retracted position and protracted position. In a retractable writing instrument such as that which is illustrated in FIG. 1, the spring serves no other function than to exert an axially directed biasing force on the cartridge to assist in the retracting and protracting of the cartridge tip. The plunger 16 of writing instrument 10 includes a forward contact surface 18 against which cartridge 14 abuts. More particularly, a unique plug member 20 is disposed in the rear end of cartridge 14 which abuts against the forward contact surface 18 of plunger 16. The structure and function of plug member 20 will be discussed in greater detail hereinbelow.

Turning to FIG. 2, there is illustrated plug member 20 which provides two unique shock absorption features that are intended to improve the operation and protect the structural integrity of the ink cartridge 14 with which it is associated. The first shock absorption feature is intended to inhibit separation of the ink from the ball point tip of the cartridge if the pen is accidentally dropped on its rear end. The second shock absorption feature is intended to prevent damage to the ball point tip of the pen if the user exerts excessive force while writing, or if the pen is dropped on its tip, causing the tip to become dislodged from the seat in which it is housed. In addition, plug member 20 provides a novel circuitous pathway for permitting airflow into the cartridge 14 to limit the accumulation of humidity therein. Each of these features are discussed hereinbelow.

As illustrated in FIG. 2, plug member 20 is defined by a substantially cylindrical body portion 22 defining a circumferential outer wall 24. A helical rib member 25 defines a channel 26 which extends about the circumferential wall 24 to form a pathway for permitting airflow into the body of ink cartridge 14. An axial recess 28 is also formed in plug member 20 and extends partially through the body portion 22 thereof from rear end 30. In addition, a transverse slotway 32 extends through the circumferential wall 24 to communicate channel 26 and axial recess 28 for directing airflow into cartridge 14 as illustrated by arrow "A" in FIG. 3.

Referring once again to FIG. 2, taken in conjunction with FIG. 3, the shock absorption feature of plug member 20 is provided by an annular flange 34 which is formed at the rear end 30 thereof. Flange 34 serves to define a cushioning buffer between the rear end of the ink cartridge 14 and the plunger 16 of writing instrument 10. The shock absorbing character of flange 34 is achieved by forming the plug member 20 from a soft pliable material such as rubber. Preferably, the pliable material from which plug member 20 is formed is SANTOPRENE brand rubber which is available from Advanced Elastomer Systems. It is envisioned however that other similar materials possessing pliable characteristics can be used to construct plug member 20, such as for example neoprene.

By providing a shock absorbing cushioning buffer of a soft pliable material between the ink cartridge 14 and the plunger 16, two structural safeguards become associated with the cartridge. In particular, the cushioning buffer substantially lessens the likelihood that the ink contained within the cartridge 14 will become separated from the ball point tip 15 if the pen is accidentally dropped on its rear end. Additionally, the ball point tip 15 is protected from damage which may be caused by the user pressing too hard on the tip while writing, or if the pen is dropped on its tip. The pliable flange portion of the plug member will serve to absorb the excess pressure on the tip, while improving the comfort of the writer.

Figure 4:
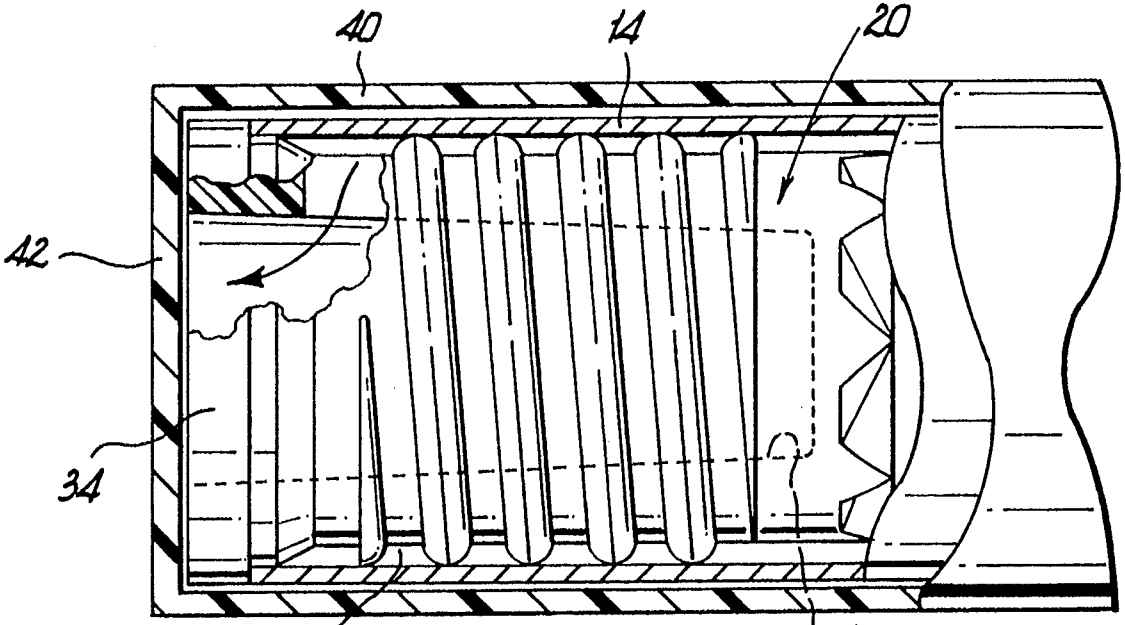
FIG. 4 is a side elevational view of another writing instrument equipped with the ink cartridge of the subject invention.

Turning to FIG. 4, the ink cartridge 14 of the subject invention is shown in conjunction with a conventional writing instrument barrel 40 having a stationary rear wall 42 against which the cartridge abuts. The cushioning flange 34 of plug member 20 abuts against the rear wall 42 of barrel 40 to inhibit the separation of ink from the ball point tip of ink cartridge 14 and to absorb excessive pressure exerted on the tip 15 by the user.

Although the subject invention has been described with respect to a preferred embodiment, it is apparent that changes or modifications made be made thereto without departing from the spirit or scope of the invention as defined by the appended claims.

What is claimed is:

1. A cartridge for a retractable writing instrument, said writing instrument having an abutment surface against which said cartridge abuts, said cartridge comprising:

a) an elongated tubular body for containing ink having a front end including means for applying the ink; and b) a plug member having a cylindrical body portion formed of a substantially pliable material disposed at least partially in a rear end of said tubular body, said plug member including:

i) an axial recess extending partially into said cylindrical body portion from a rear end thereof, a circumferential wall portion defining a helical channel about said body portion, and a pathway extending radially within said cylindrical body portion communicating said helical channel with said axial recess; and ii) means formed monolithic with said body portion for cushioning said tubular member against the abutment surface of said writing instrument.

2. A cartridge as recited in claim 1, wherein said plug member comprises a substantially cylindrical body portion.

3. A cartridge as recited in claim 1, wherein said means for cushioning said cartridge comprises an annular flange portion formed at a rear end of said cylindrical body portion.

4. A cartridge as recited in claim 3, wherein said cushioning means is constructed of an ethylene propylene thermoplastic rubber material.

5. A cartridge as recited in claim 3, wherein said cushioning means is constructed of a neoprene rubber material.

6. A cartridge for a retractable writing instrument, said writing instrument having an abutment surface against which said cartridge abuts, said cartridge comprising:

a) an elongated tubular body for containing ink having a front end including means for applying the ink; and b) a substantially cylindrical plug member formed of a pliable material disposed at least partially in a rear end of said tubular body, said plug member including:

i) an axial recess extending partially through said plug member from a rear end thereof, a helical channel defined about a circumferential wall of said plug member, and a pathway extending radially therethrough from a portion of said helical channel to said axial recess; and ii) an annular flange portion formed monolithic with said plug member at a rear end thereof for cushioning said cartridge against the abutment surface of said writing instrument to inhibit separation of the ink from said applying means and absorb pressure exerted upon said ink applying means during writing.

7. A cartridge as recited in claim 6, wherein said plug is constructed of an ethylene propylene thermoplastic rubber material.

8. A cartridge as recited in claim 6, wherein said plug is constructed of a neoprene rubber material.

9. A cartridge as recited in claim 6, wherein said means for applying the ink is a ball point applicator tip.

10. A writing instrument having a cartridge, a barrel for housing said cartridge, and a plunger member including an abutment surface against which a rear end of said cartridge abuts, said plunger and abutment surface being movable with respect to said housing to retract and protract said cartridge, said cartridge comprising:

a) an elongated tubular body for containing ink having a front end including means for applying the ink; and b) a substantially cylindrical plug member formed of a pliable material disposed at least partially in a rear end of said tubular body, said plug member including:

i) an axial recess extending partially through said plug member from a rear end thereof, a helical channel defined about a circumferential wall of said plug member, and a pathway extending radially therethrough from a portion of said helical channel to said axial recess; and ii) an annular flange formed monolithic with said plug member at a rear end thereof for cushioning said cartridge against the movable abutment surface of said plunger to inhibit separation of the ink from said applying means and absorb pressure exerted upon said ink applying means.

11. A writing instrument as recited in claim 10, wherein said cushioning means is constructed of an ethylene propylene thermoplastic rubber material.

12. A writing instrument as recited in claim 10, wherein said cushioning means is constructed of a neoprene rubber material.

13. A writing instrument as recited in claim 10, wherein said means for applying the ink is a ball point applicator tip.

14. A cartridge for a retractable writing instrument, said writing instrument having an abutment surface against which said cartridge abuts, said cartridge comprising:

a) an elongated tubular body for containing ink having a front end including means for applying the ink and an inner circumferential wall surface; and b) a plug member having a cylindrical body portion formed of a substantially pliable material disposed at least partially in a rear end portion of said tubular body and in engagement with said inner wall surface, said plug member including:

i) an axial recess extending partially through said cylindrical body portion from a rear end thereof, a helical channel defined about an outer circumferential wall of said body portion and enclosed by said inner circumferential wall of said tubular body, and a pathway extending radially within said cylindrical body portion communicating said axial recess with said helical channel; and ii) means for cushioning said cartridge against the abutment surface of said writing instrument to inhibit separation of the ink from said ink applying means and absorb pressure exerted upon said ink applying means.

* * * * *